US006968715B2

(12) United States Patent
Inumaki et al.

(10) Patent No.: US 6,968,715 B2
(45) Date of Patent: Nov. 29, 2005

(54) MAGNETIC NEEDLE SELECTING DEVICE OF WEFT KNITTING MACHINE

(75) Inventors: Masanori Inumaki, Wakayama (JP); Hiroyuki Ueyama, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 43 days.

(21) Appl. No.: 10/512,148

(22) PCT Filed: Apr. 10, 2003

(86) PCT No.: PCT/JP03/04588

§ 371 (c)(1),
(2), (4) Date: Oct. 22, 2004

(87) PCT Pub. No.: WO03/091490

PCT Pub. Date: Nov. 6, 2003

(65) Prior Publication Data

US 2005/0103059 A1 May 19, 2005

(30) Foreign Application Priority Data

Apr. 23, 2002 (JP) ..... 2002-120522

(51) Int. Cl.[7] ..... D04B 37/04
(52) U.S. Cl. ..... 66/219; 66/75.2
(58) Field of Search ..... 66/219, 75.1, 75.2, 66/215, 216, 217, 218, 220, 221

(56) References Cited

U.S. PATENT DOCUMENTS 3,955,384 A * 5/1976 Hasegawa et al. ..... 66/219
4,222,247 A * 9/1980 Hashimoto et al. ..... 66/75.2
5,090,219 A * 2/1992 Schick ..... 66/219
5,694,792 A 12/1997 Nakamori et al.

FOREIGN PATENT DOCUMENTS

EP 0431674 * 6/1991 ..... 66/219
JP 5-321102 12/1993

* cited by examiner

*Primary Examiner*—Danny Worrell
(74) *Attorney, Agent, or Firm*—Wenderoth, Lind & Ponack. L.L.P.

(57) ABSTRACT

In a magnetic-type needle selection device of a flat knitting machine, a power supply control device controls a current-application interval, during which an electric current is applied to a selector actuator, in accordance with the moving speed of a carriage. The power supply control device is structured so that, when the moving speed of the carriage is high, the current-application interval is lengthened by moving further forward a power-supply starting position than when the moving speed of the carriage is medium. When the moving speed of the carriage is low, the current-application interval is shortened by moving further backward the power-supply starting position and moving further forward a power-supply stopping position than when the moving speed of the carriage is medium.

6 Claims, 7 Drawing Sheets

| position | a | b | c | d |
|---|---|---|---|---|
| detecting elementA | OFF | ON | ON | OFF |
| detecting elementB | OFF | OFF | ON | ON |

MAGNETIC NEEDLE SELECTING DEVICE OF WEFT KNITTING MACHINE

TECHNICAL FIELD

This invention relates to a magnetic-type needle selection device of a flat knitting machine.

BACKGROUND ART

A large number of knitting needles are arranged in the needle beds of a flat knitting machine in a state of being contained in needle grooves slidably back and forth. Knitting needles selected by a selector actuator according to knitting data are forward and backward operated by a group of cams mounted on a carriage that reciprocates over the needle beds, so that the flat knitting machine can knit fabrics having a jacquard pattern, a design pattern, etc.

For example, as described in Japanese Published Unexamined Patent Application Publication No. H5-321102 and Japanese Published Unexamined Patent Application No. H9-241952, a device using a fixed electromagnet is known as a needle-selecting means for selecting knitting needles that are forward and backward operated. A device using a fixed electromagnet can select needles at a high speed and has fewer troubles during knitting because a selector actuator is fixed.

The fixed electromagnet of the selector actuator can be classified into two types one of which is a current-application hold type that is adsorbed to an end of a desired selector by applying an electric current to the coil of a pole from a power supply control unit and the other of which is a current-application release type that releases the adsorption of an end of a desired selector by applying an electric current to the coil of the pole from the power supply control unit. The needle selection device of the current-application release type has an advantage, for example, in enabling easy handling at the time of a power failure or at the time of power recovery after a power failure.

A carriage is provided with a selector actuator made up of a permanent magnet and an electromagnet excited by being supplied with electric power from the power supply control unit. This selector actuator selects desired needles by adsorbing the selector by means of the permanent magnet, by canceling the magnetic flux of the permanent magnet by use of the magnetic flux of the electromagnet excited by the current supplied from the power supply control unit, and by undoing the adsorption of the selector.

In this magnetic-type needle selection device, a current-application interval from the start of current application by which the electromagnet is actuated to the end thereof is set at a predetermined interval, for example, at ½ of a gauge pitch.

In more detail, detecting elements "A" and "B" that detect the selector have been conventionally provided in order to detect a power-supply starting position and a power-supply stopping position, for example, as shown in FIG. 6. The distance between knitting needles is detected as four positions "a" to "d" as shown in FIG. 7A and FIG. 7B by turning the detecting elements "A" and "B" on and off. Based on the detection of these four positions, the power-supply starting position E1 and the power-supply stopping position E2 are controlled so that the power supply (i.e., current application) is started at, for example, position "b" is stopped at position "d."

After a predetermined rise time S elapses, a desired magnetic flux G is generated in the electromagnet as shown in FIG. 7 by being supplied with an electric current from the power supply means as mentioned above.

In the magnetic-type needle selection device, a positional coincidence is established between the center PC of a current-application interval P determined by the power-supply starting point "b" and the power-supply stopping point "d" and the center WC in the width direction W of a selector to be selected when the carriage moves at a general moving speed (see FIG. 6).

The flat knitting machine knits fabrics while reciprocating the carriage over needle beds. At this time, the carriage is repeatedly accelerated and decelerated by its reversals, so that the moving speed of the carriage in one course is not always constant. Not only when the carriage is reversed but also when the carriage is midway in the course, cases occur in which the moving speed of the carriage is changed.

As in the conventional magnetic-type needle selection device, a current-application interval from the start of a power supply operation by which the electromagnet is actuated to the end thereof is set at, for example, ½ of the gauge pitch of the flat knitting machine. Therefore, a knitting machine having a coarse gauge can cope with a change in moving speed of the carriage with a relatively large margin. On the other hand, a knitting machine having a fine gauge has a current-application interval P1 shortened as shown in FIG. 5A and FIG. 5B. As a result, the period of time of an F portion that effectively acts on a selector selected by the electromagnet (i.e., the period of time of a flat portion obtained by subtracting a rise time S from a current-application interval P in the figures) becomes short, and, in addition, the rise time S of a magnetic flux generated in the electromagnet by the power supply means is substantially constant regardless of the moving speed of the carriage. Hence, the F portion is dislocated toward the upper side in the moving direction of the carriage from the center of a selector to be selected.

Therefore, in a fine-gauge knitting machine having twelve or more gauges, the magnetic flux of the electromagnet rises late when the carriage moves at a high speed. On the other hand, when the carriage moves at a low speed, if the power-supply starting point of time is early, magnetism affects a next selector on the forward side, and, if the power-supply stopping point of time is late, residual magnetism affects the following selector. Therefore, disadvantageously, an error in selecting needles is liable to occur.

The aforementioned problem also arises when the knitting machine is cooled so that the viscosity of a lubricant becomes high and when adhesion of dust or the like makes the movement of the selector slow.

Additionally, disadvantageously, if dimensional errors or assembly errors of related components exist in the fine-gauge knitting machine, the knitting machine cannot cope with a change in moving speed of the carriage as in the aforementioned case, and much time will be taken to adjust it.

DISCLOSURE OF INVENTION

It is an object of the present invention to provide a flat knitting machine capable of fully exhibiting its performance without making an error in selecting needles within the range of the moving speed of a carriage.

In order to achieve the object, a magnetic-type needle selection device of a flat knitting machine of the present invention comprises at least one pair of needle beds; a carriage that moves over the needle beds; a plurality of needle grooves formed in each needle bed, the needle grooves slidably containing needles; a magnetic needle-selection mechanism provided on the carriage, the magnetic needle-selection mechanism capable of selecting needles by supplying an electric current to an electromagnetic coil, by canceling a magnetic flux of an adsorption surface of a selector actuator, and by releasing a knitting member, such as a selector, that has been adsorbed to the adsorption surface from the adsorption surface; the magnetic-type needle selection device of the flat knitting machine characterized by further comprising a carriage speed detecting means for detecting the moving speed of the carriage; and a power supply control means for controlling a current-application interval of an electric current supplied to the selector actuator in accordance with a carriage speed detected by the carriage speed detecting means.

Accordingly, it is possible to prevent the occurrence of an error in selecting needles within the range of the moving speed of the carriage even if the gauge of the knitting machine is fine.

Additionally, there is an advantage in the fact that the tolerance of dimensional errors or assembly errors of related components becomes large and therefore adjustments can be made in a short time without consuming much time to correct the errors even if there exist such dimensional errors or assembly errors of related components.

Preferably, the power supply control means is structured so that, when the moving speed of the carriage is high, the current-application interval becomes longer by moving further forward a power-supply starting position than when the moving speed of the carriage is medium.

Accordingly, it is possible to compensate a delay in the rise of the magnetic flux of an electromagnet and prevent the occurrence of a needle selection error.

Preferably, the power supply control means is structured so that the power-supply stopping position is moved further backward when the moving speed of the carriage is high than when the moving speed of the carriage is medium.

Accordingly, it is possible to prevent the occurrence of a needle selection error, for example, when the knitting machine is cooled so that the viscosity of a lubricant becomes high or when the adhesion of dust or the like makes the movement of a selector slow.

Preferably, the power supply control means is structured so that the power-supply starting position is moved further backward when the moving speed of the carriage is low than when the moving speed of the carriage is medium, and the current-application interval is shortened by moving further forward the power-supply stopping position.

Accordingly, it is possible to remove the influence of magnetism upon an adjoining selector and prevent the occurrence of a needle selection error.

BEST MODE FOR CARRYING OUT THE INVENTION

An embodiment of the present invention will be hereinafter described with reference to the attached drawings.

In a needle selection device of this embodiment, the needles are selectively guided to three positions, i.e., an advanced position (knit), an intermediate position (tuck), and a stationary position (welt), which are called "A position," "H position," and "B position," respectively.

The needle selection device of the present embodiment can be utilized for stitch transfer, etc., and the stationary position serves also as the initial position of the needle. In the present embodiment, a movement toward a trick gap between a pair of needle beds is defined as an advancement, and a movement in the opposite direction is defined as a withdrawal.

With regard to cams of the carriage, one that is closer to the needle beds is defined as a higher cam, and one that is more distant from the needle beds is defined as a lower cam.

Figure 1:
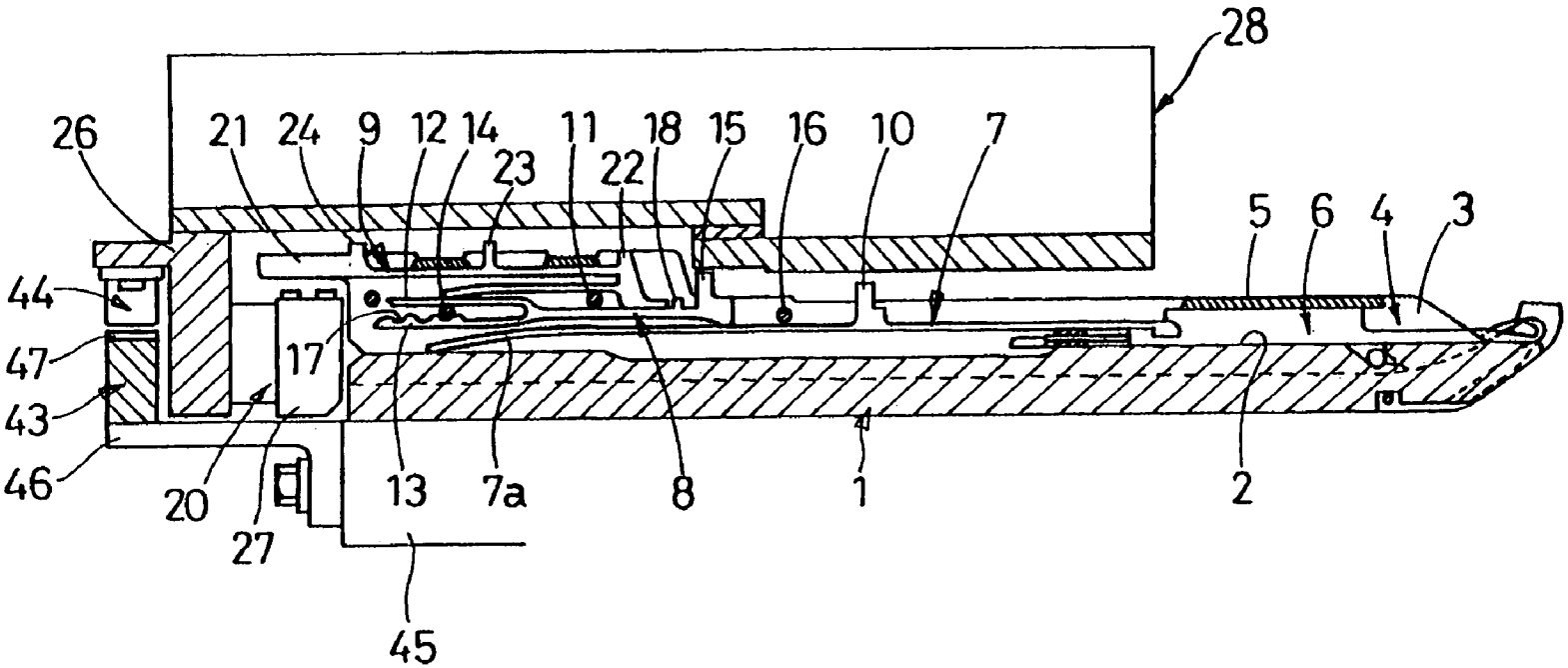
FIG. 1 is a longitudinal sectional side view of a needle bed part of a magnetic-type needle selection device of a flat knitting machine according to the present invention.

FIG. 1 is a longitudinal sectional side view of a knitting needle part contained in a needle groove of a needle plate. The needle bed 1 is provided with a plurality of grooves 2 parallel to each other. A needle plate 3 is fitted into the groove 2, and a needle groove 4 is formed between two adjoining needle plates 3 and 3.

A metal strip 5 is passed through a large number of needle plates 3 arranged in a row so as to prevent the needles 6 and the like from coming off. A needle 6, a needle jack 7, a select jack 8, and a selector 9 are slidably inserted in each needle groove 4.

The needle jack 7 has its tip fitted in the tail of the needle 6. A needle jack butt 10 is formed at the center of the needle jack 7. An elastic leg portion 7*a* provided in the tail of the needle jack 7 presses the needle jack butt 10 so that the needle jack butt 10 will protrude out of the needle groove 4.

The tip of the select jack 8 is located above the needle jack 7, and the upper surface of the center of the select jack 8 is in contact with a wire 11. The tail of the select jack 8 has fork ends 12 and 13, which are in contact with a wire 14.

The wires 11 and 14 pierce the needle plates 3 and hold the select jack 8 in each needle groove 4 while being in contact with the upper surface of the select jack 8.

An elastic force allowing the needle jack 7 to protrude out of the needle groove 4 is transmitted to the tip of the select jack 8, and the select jack butt 15 is pressed to protrude out of the needle groove 4 (i.e., protrude upwards).

The select jack 8 reciprocates in the needle groove 4, and its most advanced position coincides with "A position" of the select jack butt 15 where its tip is brought into contact with the wire 16. "A position," "H position," and "B position" are determined by three dents, respectively, that are formed in the upper surface of the lower leg 17 of the fork ends 12, 13.

The top end of the selector 9 has a tip that is engaged with the butt 18 to advance the select jack 8 toward the "H position" or "A position." The tail end of the selector 9 has an armature 21 that is adsorbed by a magnetic needle-selection mechanism 20 described later. The armature 21 is in a state of protruding from the tail end of the needle groove 4. The upper surface of the selector 9 is provided with three butts 22, 23, and 24 that are operated by a group of cams (not shown) of the carriage 28.

A bracket 26 having an L-shaped section is provided on a portion that protrudes backward beyond the tail end of the selector 9, and the needle selection mechanism 20 is comprised of a selector actuator 27 mounted to face the under-surface of the armature 21 and a power supply control device 40 described later.

Figure 2:
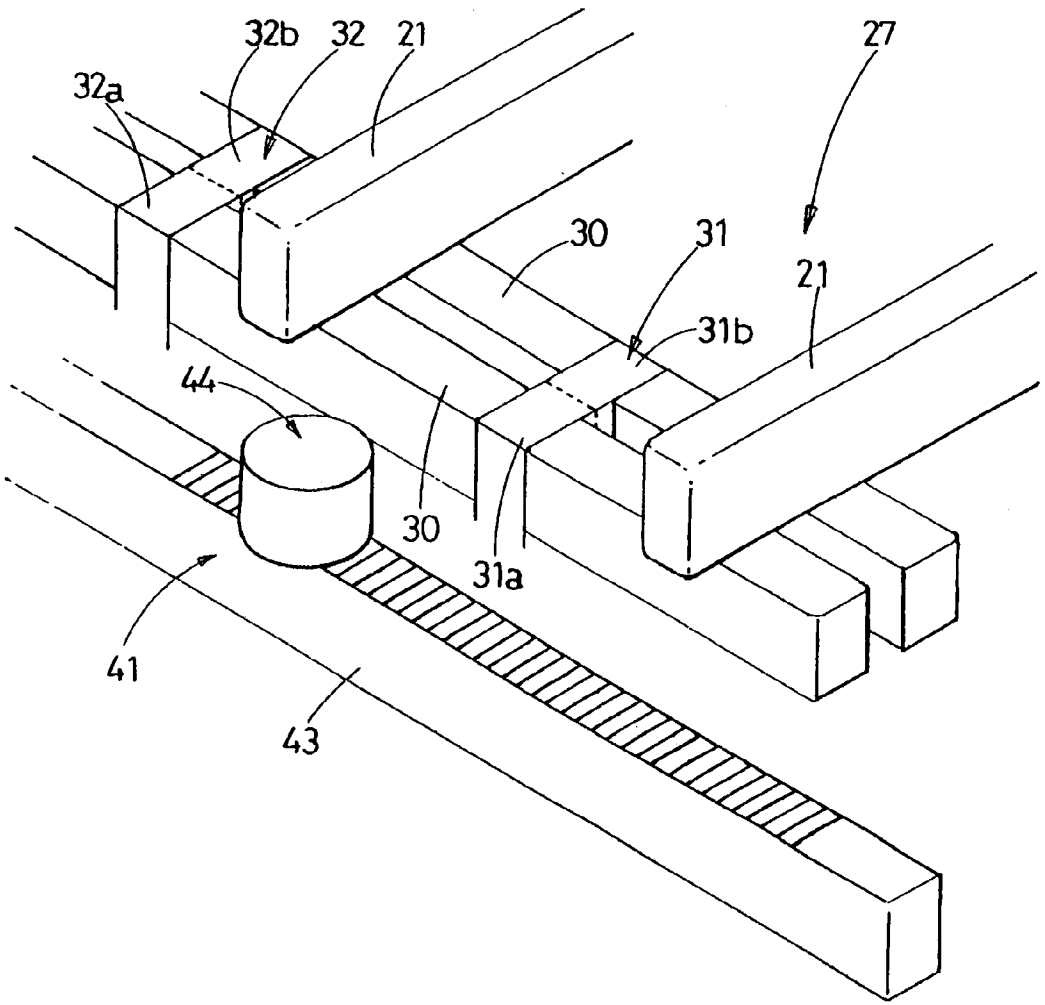
FIG. 2 is a perspective view showing the outline of a magnetic needle-selection mechanism of the magnetic-type needle selection device of the flat knitting machine according to the present invention.

As shown in FIG. 2, the actuator 27 is provided with two upper and lower rows of adsorption surfaces 30 magnetized by permanent magnets (not shown) and at first and second needle selection sites 31 and 32 arranged at an appropriate interval. The selection sites 31 and 32 have pole pieces 31*a*, 31*b*, 32*a*, and 32*b* of the electromagnetic coils (not shown) of current-application release type electromagnets. Each of the pole pieces 31*a*, 31*b*, 32*a*, and 32*b* is flush with the adsorption surface 30.

The power supply control device 40 that is a constituent element of the needle selection mechanism 20 is made up of a position detector 41 that detects the position of the carriage, a carriage speed detector 47 that detects the moving speed of the carriage 28 in real time, and a coil current determiner 52 that determines power-supply starting and stopping positions in accordance with a carriage speed detected by the carriage speed detector 47. A current-application interval during which an electric current is applied is controlled by determining the power-supply starting and stopping positions.

Figure 3:
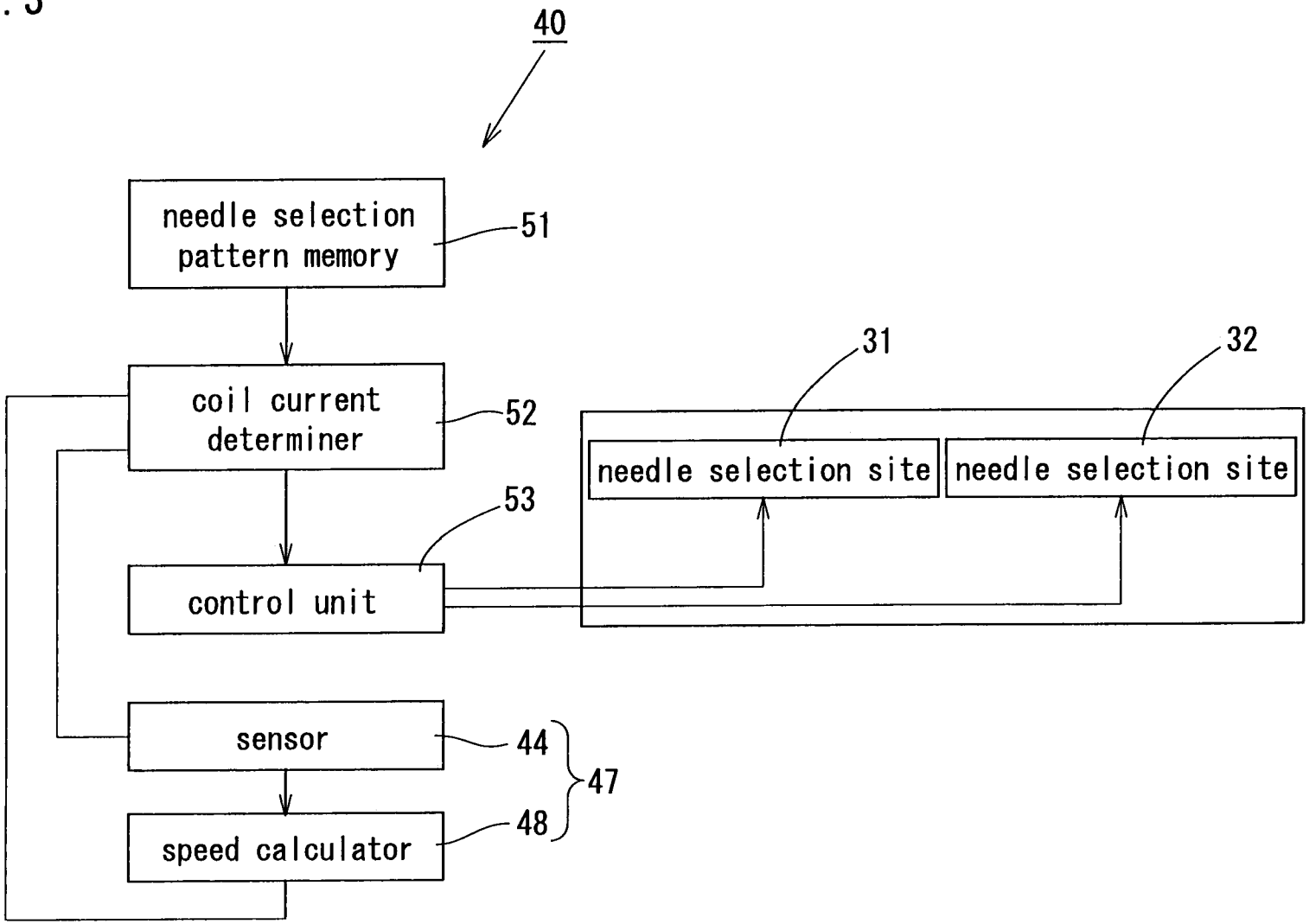
FIG. 3 shows a power supply control circuit of the magnetic-type needle selection device of the flat knitting machine according to the present invention.

As shown in FIG. 3, the position detector 41 includes a sensor 44 that reads information of a linear scale 43, and the carriage speed detector 47 includes a speed calculator 48 that receives a pulse signal from the sensor 44 and then calculates the speed of the carriage 28 in real time based on the quantity or period of the pulse signal.

It is possible to calculate the speed of the carriage 28 based on the position and movement time of the carriage 28 by using the linear scale 43 instead of the speed calculator 48 that calculates the speed of the carriage 28 in real time.

Additionally, it is permissible to calculate the speed of the carriage 28 based on a command signal issued to a driving motor (not shown) by which the carriage 28 is driven.

As shown in FIG. 1, the linear scale 43 is attached to a supporting arm 46 along the longitudinal direction of the needle bed 1, i.e., along the moving direction of the carriage 28. The supporting arm 46 is mounted on a frame 45 that supports the needle bed 1.

As shown in FIG. 2, a magnetic substance is embedded in a part of the upper surface of the linear scale 43 on the side of the carriage 28 in the form of a so-called magnet scale like a bar code.

On the other hand, the sensor 44 that reads the magnetic substance embedded in the surface of the linear scale 43 is a magnetic sensor attached to the lower end of the carriage 28 with the bracket 26 therebetween in a state in which its reading surface faces the upper surface of the linear scale 43.

The sensor 44 of the position detector 41 is high in resolution, and therefore can detect the position of the carriage 28 with high resolution to accurately ascertain power-supply starting and stopping positions.

Figure 7A:
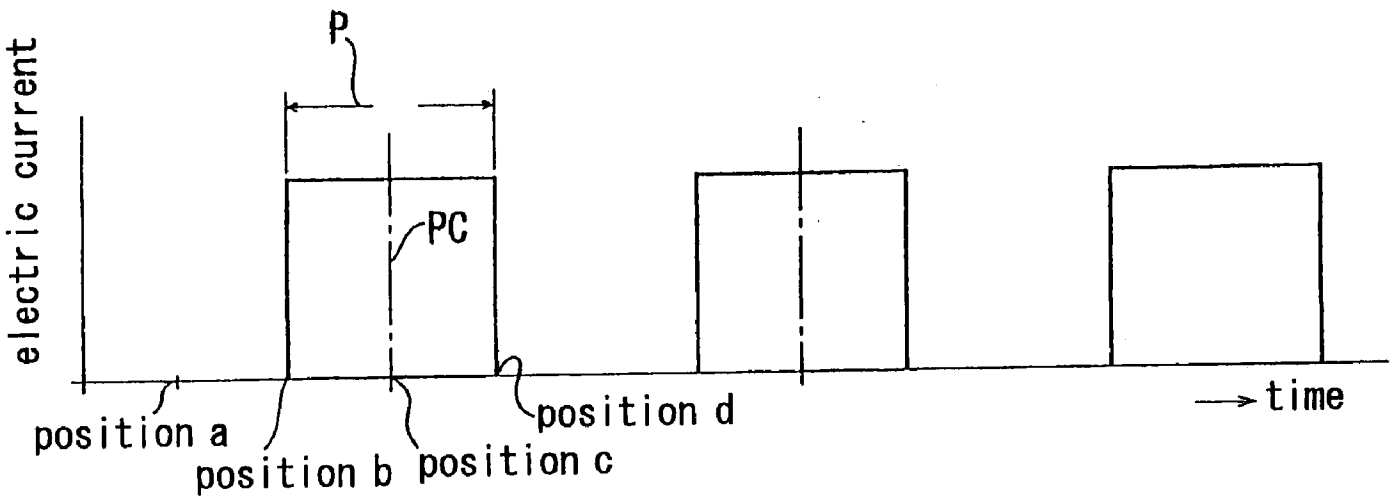
FIG. 7 is a graph showing the relationship between a sensor signal and the generation of a magnetic flux of the magnetic-type needle selection device of the conventional flat knitting machine.
Figure 7B:
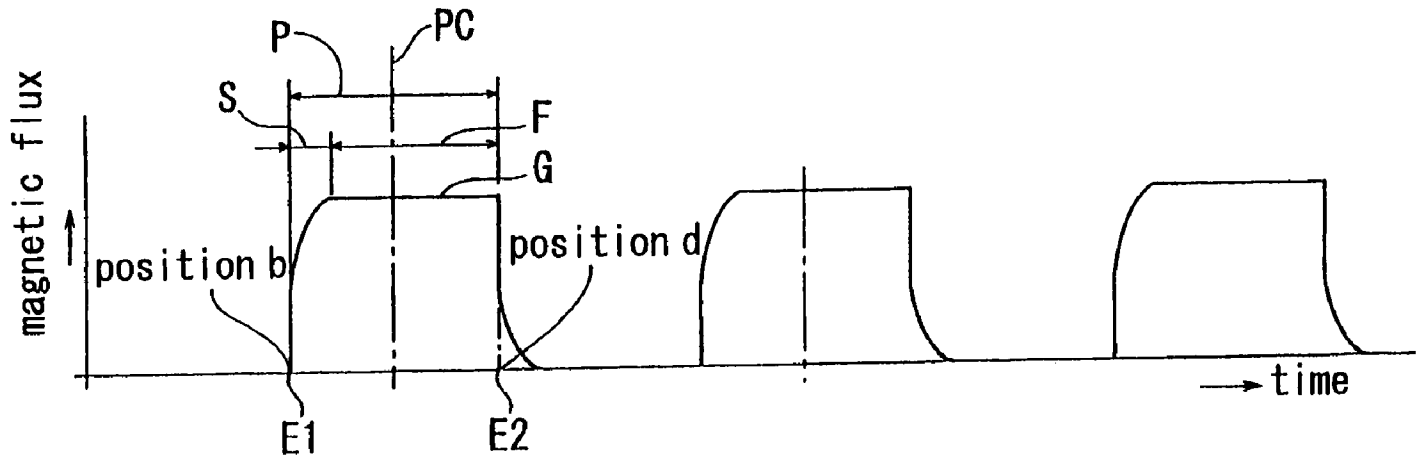

As shown in FIG. 3, in the power supply control device 40, the power-supply starting position E1 and the power-supply stopping position E2 of the pole pieces 31*a*, 31*b*, 32*a*, and 32*b* to the coils are determined by a needle selection pattern memory 51 in the needle selection data that is part of knitting data and by a coil current determiner 52 that determines a power supply position, where an electric current is supplied to the coils, in accordance with a detection signal regarding the position of the carriage that is emitted from the sensor 44 and in accordance with the speed of the carriage 28 detected by the carriage speed detector 47. The space between the power-supply starting position E1 and the power-supply stopping position E2 shown in FIG. 7 is a current-application interval P.

Figure 4:
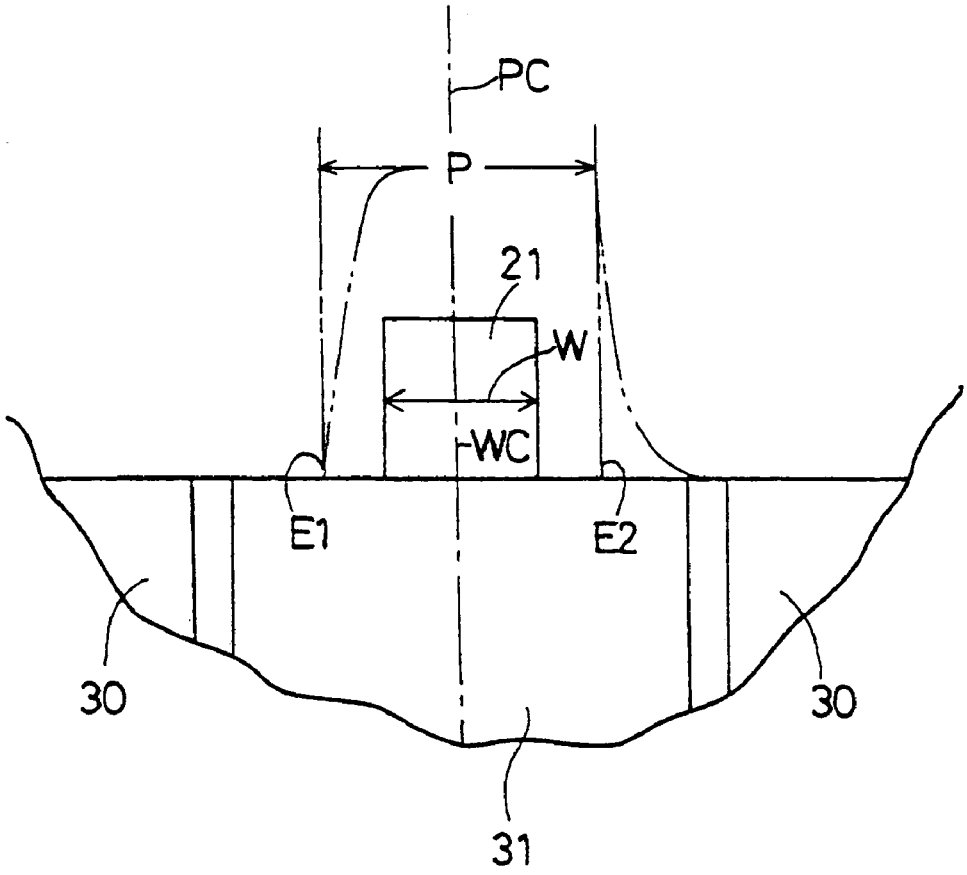
FIG. 4 is a schematic view showing the relationship among current application, a selector, and a needle selection part of the magnetic-type needle selection device of the flat knitting machine according to the present invention.

The power-supply starting position E1 and the power-supply stopping position E2, at which electric power supply to the electromagnetic coils by which the pole pieces 31*a*, 31*b*, 32*a*, and 32*b* are excited is started and stopped, are basically set as positions for a medium speed within the range of the moving speed of the carriage 28, and, as shown in FIG. 4, a positional coincidence is established between the center PC of the current-application interval P and the center WC in the width direction W of the selector 9.

In this embodiment, the moving speed of the carriage 28 ranges from 0.0 to 1.5 m/s. The speed closer to the maximum speed is defined as high, the intermediate speed is defined as medium, and the speed closer to the stop is defined as low.

When the speed of the carriage 28 is set at "high" faster than "medium," the power-supply starting position E1 is advanced, and the power-supply stopping position E2 is delayed, whereby the current-application interval P is lengthened.

A delay in the rise of a magnetic flux is compensated by advancing the power-supply starting position E1 in this way, and the selector 9 can be reliably released by delaying the power-supply stopping position E2. Therefore, the knitting machine can cope with a case in which, for example, the knitting machine is cooled so that the viscosity of a lubricant becomes high or a case in which the adhesion of dust or the like makes the movement of the selector slow.

Thus, electric power is supplied from a control unit 53 to the needle selection sites 31 and 32 in accordance with the power-supply starting position E1 and the power-supply stopping position E2 determined by the coil current determiner 52.

Knitting needles 6 selected by the power supply control device 40 are operated as described in, for example Japanese Published Unexamined Patent Application No. H9-241952 so as to knit fabrics in response to the reciprocation of the carriage 28 of the knitting machine having the magnetic-type needle selection device structured as mentioned above.

Figure 5A:
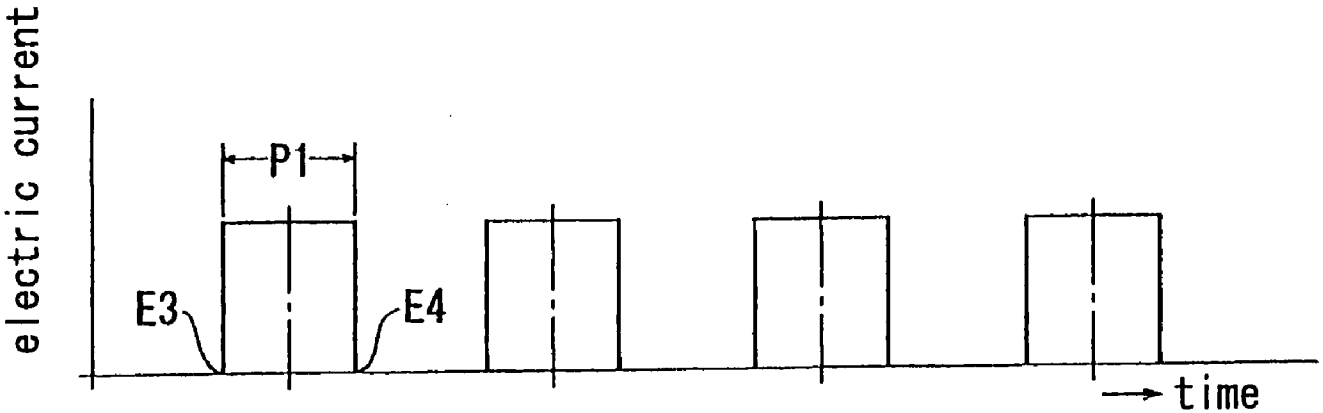
FIG. 5 is a graph showing the relationship between the generation of a magnetic flux and a sensor signal of the magnetic-type needle selection device of the flat knitting machine according to the present invention.

At this time, the position where electric power is supplied to the coils of the pole pieces 31*a*, 31*b*, 32*a*, and 32*b* is determined by the coil current determiner 52 of the power supply control device 40. That is, a power-supply starting position E3 and a power-supply stopping position E4 are determined as shown in FIG. 5A. The current-application interval is P1. This is transmitted to the control unit 53, and, when a position detected by the position detector 41 coincides with the power-supply starting position E3 where electric power is supplied to the coils, a power supply operation is started, and, when that position coincides with the power-supply stopping position E4, a power supply operation is stopped.

Figure 5B:
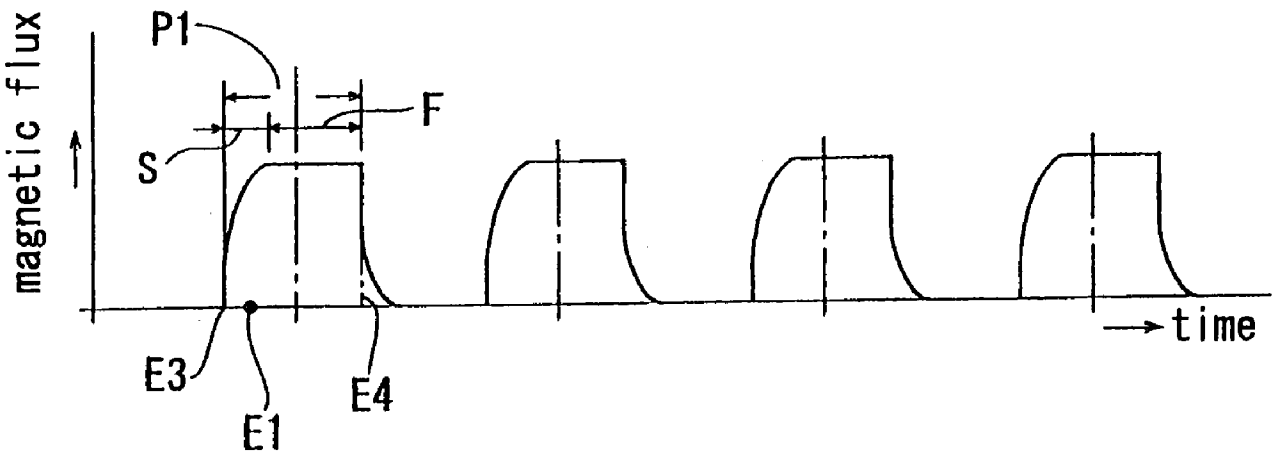
Figure 6:
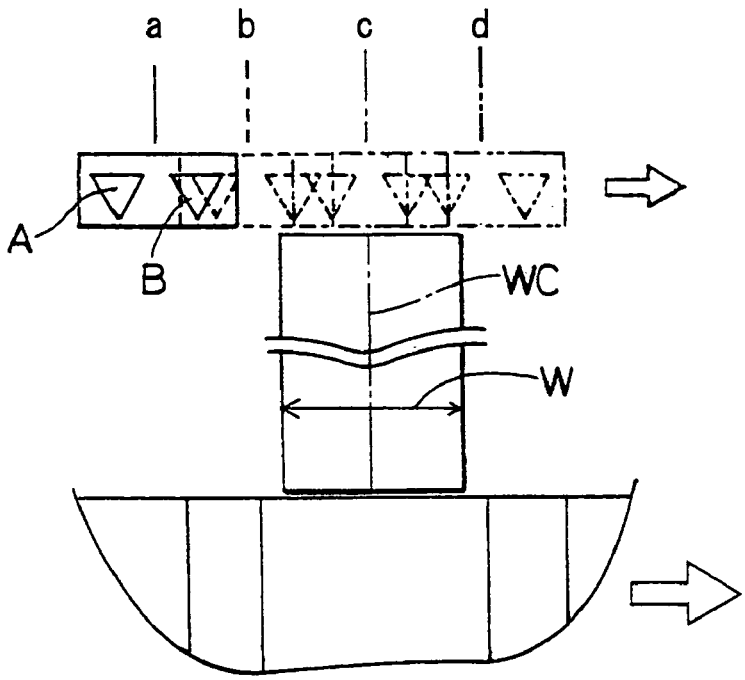
FIG. 6 is a schematic view showing the relationship between a needle selection part and a selector of a magnetic-type needle selection device of a conventional flat knitting machine.

Thus, the current-application interval P1 is lengthened because the power-supply starting position E3 is moved further forward than the power-supply starting position E1 where the moving speed of the carriage 28 is medium and because the power-supply stopping position E4 is moved further backward than the power-supply stopping position E2 as shown in FIG. 5B when electric power is supplied to the needle selection sites 31 and 32.

When the moving speed of the carriage 28 is set at "low" slower than "medium," the power-supply starting position E1 is delayed, and the power-supply stopping position E2 is advanced, whereby the current-application interval P is shortened. In the same way as above, a power-supply starting position and a power-supply stopping position where the supply of electric power to the coils is started and stopped are determined by the needle selection pattern memory 51 in the needle selection data and by the coil current determiner 52 that determines a power supply position, where an electric current is supplied to the coils, in accordance with a detection signal regarding the position of the carriage that is emitted from the sensor 44 and in accordance with the speed of the carriage 28 detected by the carriage speed detector 47, which are not shown in the attached drawings. This is transmitted to the selector actuator from the power supply device through the control unit. As a result, the power-supply starting position is delayed, and the power-supply stopping position is advanced. Therefore, influence on a forward next selector is removed, and residual magnetism does not affect the following selector.

Since the resolution of the sensor 44 is high in this embodiment, a fine adjustment to the power-supply starting and stopping positions can be controllably made.

In the aforementioned embodiment, the armature 21 adsorbed to the two upper and lower rows of flat adsorption surfaces 30 magnetized by the permanent magnets is released from its adsorption. However, without being limited to this, the present invention can be, of course, embodied in a case in which needles are selected by allowing the armature to be adsorbed to the pole pieces excited by being supplied with electric power.

Additionally, since the quantity of magnetic flux that leaks from the needle selection sites changes depending on the number of selectors adsorbed to the adsorption part, the current-application interval may be controlled in accordance with the speed of the carriage in order to select needles with higher accuracy, and the value of an electric current to be applied may be controlled in accordance with the number of selectors adsorbed thereto. Alternatively, the quantity of magnetic flux of the needle selection sites may be measured by a sensor, such as a hall element, so as to generate magnetic flux needed to cancel the quantity of magnetic flux corresponding to an obtained value.

In the aforementioned embodiment, the power-supply starting and stopping positions are finely adjusted and controlled in real time in accordance with the speed of the carriage detected by the carriage speed detecting means. However, without being limited to this, a table may be provided which has data in which the power-supply starting and stopping positions are set, for example, for high speed, medium speed, and low speed, and the power-supply starting and stopping positions may be controlled according to the table for each speed.

In the aforementioned embodiment, a magnetic substance is embedded in a part of the upper surface of the linear scale on the side of the carriage so as to form a magnet scale. However, without being limited to this, any linear scale capable of coping with high resolution may be employed in the present invention.

In the aforementioned embodiment, the speed of the carriage is described as high, medium, and low. However, without being limited to these three levels, the power-supply starting and stopping positions corresponding to each carriage speed can be, of course, controlled without levels because the high speed, medium speed, and low speed described in the present invention are relative.

What is claimed is:

1. A magnetic-type needle selection device of a flat knitting machine comprising: at least one pair of needle beds; a carriage that moves over the needle beds; a plurality of needle grooves formed in each needle bed, the needle grooves slidably containing needles; a magnetic needle-selection mechanism provided on the carriage, the magnetic needle-selection mechanism capable of selecting needles by supplying an electric current to an electromagnetic coil, by canceling a magnetic flux of an adsorption surface of a selector actuator, and by releasing a knitting member that has been adsorbed to the adsorption surface from the adsorption surface; the magnetic-type needle selection device of the flat knitting machine further comprising:

a carriage speed detecting means for detecting the moving speed of the carriage; and a power supply control means for controlling a current-application interval of an electric current supplied to the selector actuator in accordance with a carriage speed detected by the carriage speed detecting means.

2. The magnetic-type needle selection device of the flat knitting machine as set forth in claim 1, characterized in that the power supply control means is structured so that, when the moving speed of the carriage is high, the current-application interval becomes longer by moving further forward a power-supply starting position than when the moving speed of the carriage is medium.

3. The magnetic-type needle selection device of the flat knitting machine as set forth in claim 2, characterized in that the power supply control means is structured so that the power-supply stopping position is moved further backward when the moving speed of the carriage is high than when the moving speed of the carriage is medium.

4. The magnetic-type needle selection device of the flat knitting machine as set forth in claim 1, characterized in that the power supply control means is structured so that, when the moving speed of the carriage is low, the power-supply starting position is moved further backward than when the moving speed of the carriage is medium, and the current-application interval is shortened by moving further forward the power-supply stopping position.

5. The magnetic-type needle selection device of the flat knitting machine as set forth in claim 2, characterized in that the power supply control means is structured so that, when the moving speed of the carriage is low, the power-supply starting position is moved further backward than when the moving speed of the carriage is medium, and the current-application interval is shortened by moving further forward the power-supply stopping position.

6. The magnetic-type needle selection device of the flat knitting machine as set forth in claim 3, characterized in that the power supply control means is structured so that, when the moving speed of the carriage is low, the power-supply starting position is moved further backward than when the moving speed of the carriage is medium, and the current-application interval is shortened by moving further forward the power-supply stopping position.

* * * * *